US006368054B1

(12) United States Patent
Lucas

(10) Patent No.: US 6,368,054 B1
(45) Date of Patent: Apr. 9, 2002

(54) SPLIT RING FOR TIP CLEARANCE CONTROL

(75) Inventor: Terry Lucas, Candiac (CA)

(73) Assignee: Pratt & Whitney Canada Corp., Quebec (CA)

( * ) Notice: Subject to any disclaimer, the term of this patent is extended or adjusted under 35 U.S.C. 154(b) by 0 days.

(21) Appl. No.: 09/459,993

(22) Filed: Dec. 14, 1999

(51) Int. Cl.[7] ..... F01D 11/08

(52) U.S. Cl. ..... 415/135; 415/173.3; 415/174.2; 415/138

(58) Field of Search ..... 415/135, 138, 415/136, 115, 116, 173.1, 173.3, 174.2, 189

(56) References Cited

U.S. PATENT DOCUMENTS

| | | | | |
|---|---|---|---|---|
| 3,836,279 A | | 9/1974 | Lee | |
| 4,307,993 A | | 12/1981 | Hartel | |
| 4,337,016 A | | 6/1982 | Chaplin | |
| 4,398,866 A | | 8/1983 | Hartel et al. | 415/173.1 |
| 4,411,594 A | | 10/1983 | Pellow et al. | |
| 4,426,191 A | * | 1/1984 | Brodell et al. | 415/189 |
| 4,477,086 A | | 10/1984 | Feder et al. | |
| 4,573,866 A | | 3/1986 | Sandy, Jr. et al. | 415/116 |
| 4,650,394 A | * | 3/1987 | Weidner | 415/115 |
| 4,669,954 A | | 6/1987 | Habarou et al. | |
| 4,679,981 A | | 7/1987 | Guibert et al. | |
| 5,333,992 A | * | 8/1994 | Kane et al. | 415/138 |
| 5,344,284 A | | 9/1994 | Delvaux et al. | |
| 5,456,576 A | | 10/1995 | Lyon | 415/173.3 |
| 5,584,651 A | | 12/1996 | Pietraszkiewicz et al. | |

FOREIGN PATENT DOCUMENTS

| | | |
|---|---|---|
| GB | 2076067 | 11/1981 |
| GB | 2129880 | 5/1984 |

* cited by examiner

*Primary Examiner*—F. Daniel Lopez
*Assistant Examiner*—Richard Woo
(74) *Attorney, Agent, or Firm*—Bachman & LaPointe, P.C.

(57) ABSTRACT

A tip clearance control device for a gas turbine engine having a shroud surrounding a stage of rotor blades. The tip clearance control device comprises a one-piece split ring having opposed overlapping end portions. The split ring is directly supported onto the inner surface of the shroud and is adapted to automatically adjust for thermal growth of the shroud during engine operation.

20 Claims, 3 Drawing Sheets

SPLIT RING FOR TIP CLEARANCE CONTROL

BACKGROUND OF THE INVENTION

1. Field of the Invention

The present invention relates to gas turbine engine and, more particularly, to dynamic control of the clearance between the tips of rotor blades and a surrounding shroud.

2. Description of the Prior Art

It has long been recognized that in order to maximize the overall efficiency of a gas turbine engine, the tip clearance between the rotor blades of the engine and the surrounding casing must be as small as possible. This constitutes a distinct problem in that the tip clearance between the tips of the blades and the surrounding casing varies non-uniformly with the operating conditions of the gas turbine engine. This is because the rotor blades and the casing have different thermal and centrifugal expansion characteristics. Indeed, the casing and the rotor blades are generally fabricated from material having different coefficient of expansion. Furthermore, the expansion and contraction of the casing is a function of the pressure and temperature, whereas the expansion and contraction of the rotor blades is affected by the centrifugal force and the temperatures of the blades an associated rotor disc within the various sections of the gas turbine engine.

One approach used to minimize and control the tip clearance between the rotor blades of a gas turbine engine and the surrounding casing is disclosed in U.S. Pat. No. 5,456,576 issued on Oct. 10, 1995 to Lyon. This patent teaches to surround a stage of rotor blades with a ring formed of a plurality of interconnected stiff segments supported by a hanging structure extending radially inwardly from an inner surface of the engine case.

In another attempt, U.S. Pat. No. 4,398,866 issued on Aug. 16, 1983 to Hartel et al. teaches to mount a relatively stiff split ring between a pair of opposed L-shaped rings supported within an engine case via a metallic clamping structure extending radially inwardly therefrom.

Although the tip clearance control devices described in the above-mentioned patents are effective, it has been found that there is a need for a simpler and less costly tip clearance control device which is adapted to reduce the radial space required to mount an annular shroud within an engine case about a stage of rotor blades.

SUMMARY OF THE INVENTION

It is therefore an aim of the present invention to provide a tip clearance control device which is relatively simple and economical to manufacture.

It is also an aim of the present invention to provide such a tip clearance device which contributes to minimize the overall weight of a gas turbine engine.

It is a further aim of the present invention to provide a tip clearance control device which contributes to minimize the radial dimensions of a gas turbine engine.

It is a still further aim of the present invention to provide a tip clearance control device which is adapted to efficiently isolate the engine case from the hot combustion gases flowing through a stage of rotor blades.

Therefore, in accordance with the present invention there is provided a tip clearance control device for a gas turbine engine having a shroud surrounding a stage of rotor blades. The tip clearance control device comprises a split ring adapted to be yieldingly biased radially outwardly into engagement with the shroud in order to surround the rotor blades and adjust for expansion and contraction of the shroud. The split ring is split at a single location so as to be capable of expansion and contraction during engine operation.

Also in accordance with the present invention, there is provided a tip clearance control device comprising a ring adapted to be mounted within a shroud for surrounding a stage of rotor blades. The ring has a radially inner surface defining with the tips of the rotor blades a tip clearance. The ring is split at a single location so as to be circumferentially expandable and contractible during engine operation. The ring is at least partly resilient and adapted to be biased radially outwardly in engagement with the shroud in order to prevent the ring from becoming loose within the shroud in response to radial expansion of the shroud during engine operation.

In accordance with a further general aspect of the present invention, there is provided a tip clearance control device for a gas turbine engine having a shroud surrounding a stage of rotor blades. The tip clearance control device comprises a one-piece ring adapted to be mounted within the shroud for surrounding the rotor blades at a radial distance from respective tips thereof. The one-piece ring has first and second opposed overlapping end portions formed at a single split location to provide an annular seal around the rotor blades, while allowing to adjust for thermal growth during engine operation. This arrangement advantageously reduces the cooling flow required to cool the shroud due to improved sealing as compared to conventional shroud segments.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
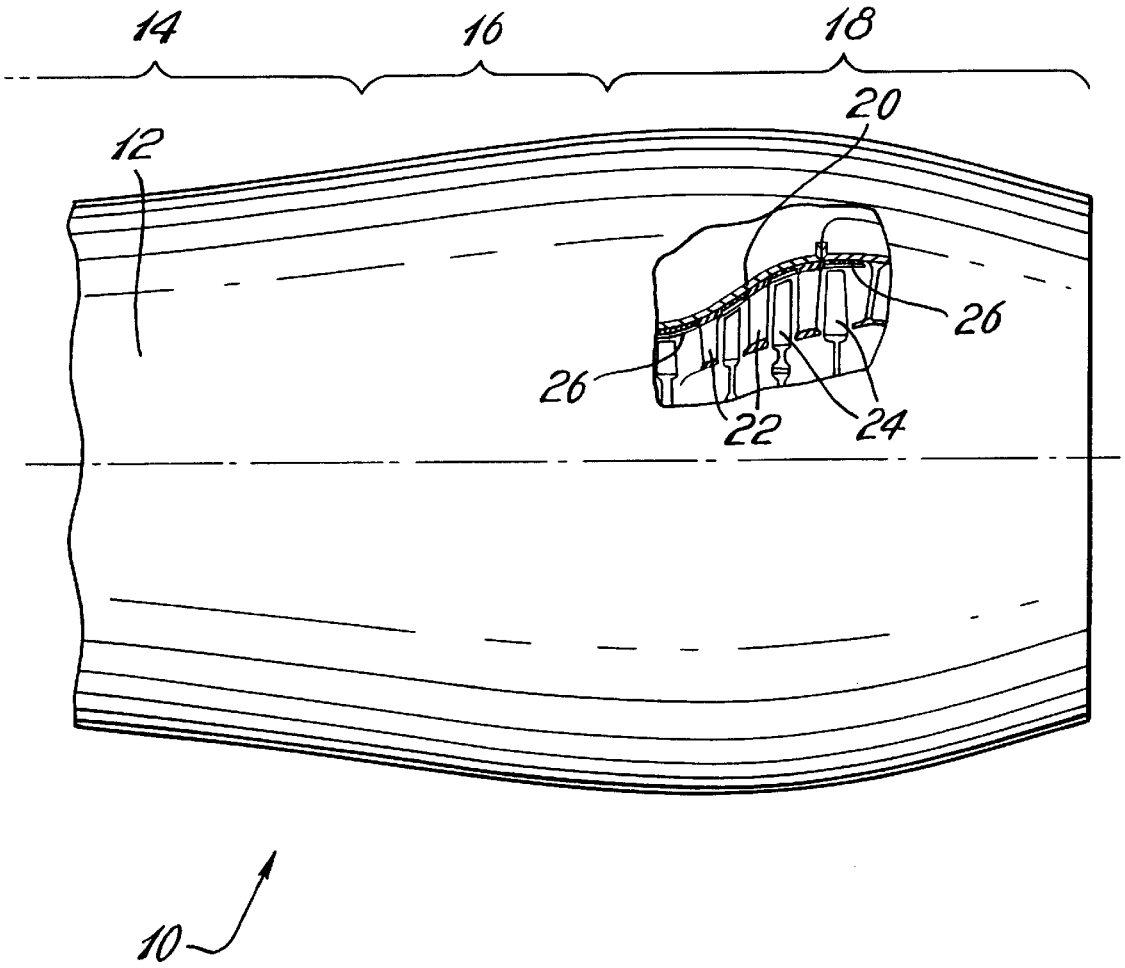
FIG. 1 is an enlarged, simplified elevation view of a gas turbine engine with a portion of an engine case broken away to show the internal structures of a turbine section in which axially spaced-apart liner rings are used in accordance with a preferred embodiment of the present invention.

Referring to FIG. 1, there is shown a gas turbine engine 10 enclosed in an engine case 12. The gas turbine engine is of conventional construction and comprises a compressor section 14, a combustor section 16 and a turbine section 18. Air flows axially through the compressor section 14, where it is compressed. The compressed air is then mixed with fuel and burned in the combustor section 16 before being expanded in the turbine section 18 to cause the turbine to rotate and, thus, drive the compressor section 14.

The turbine section 18 comprises a turbine shroud 20 secured to the engine case 12. The turbine shroud 20 encloses alternate stages of stator vanes 22 and rotor blades 24 extending across the flow of combustion gases emanating from the combustor section 16. Each stage of rotor blades 24 is mounted for rotation on a conventional rotor disc 25 (see FIG. 2*a*). Disposed radially outwardly of each stage of rotor blades 24 is a circumferentially adjacent ring liner 26.

Figure 2A:
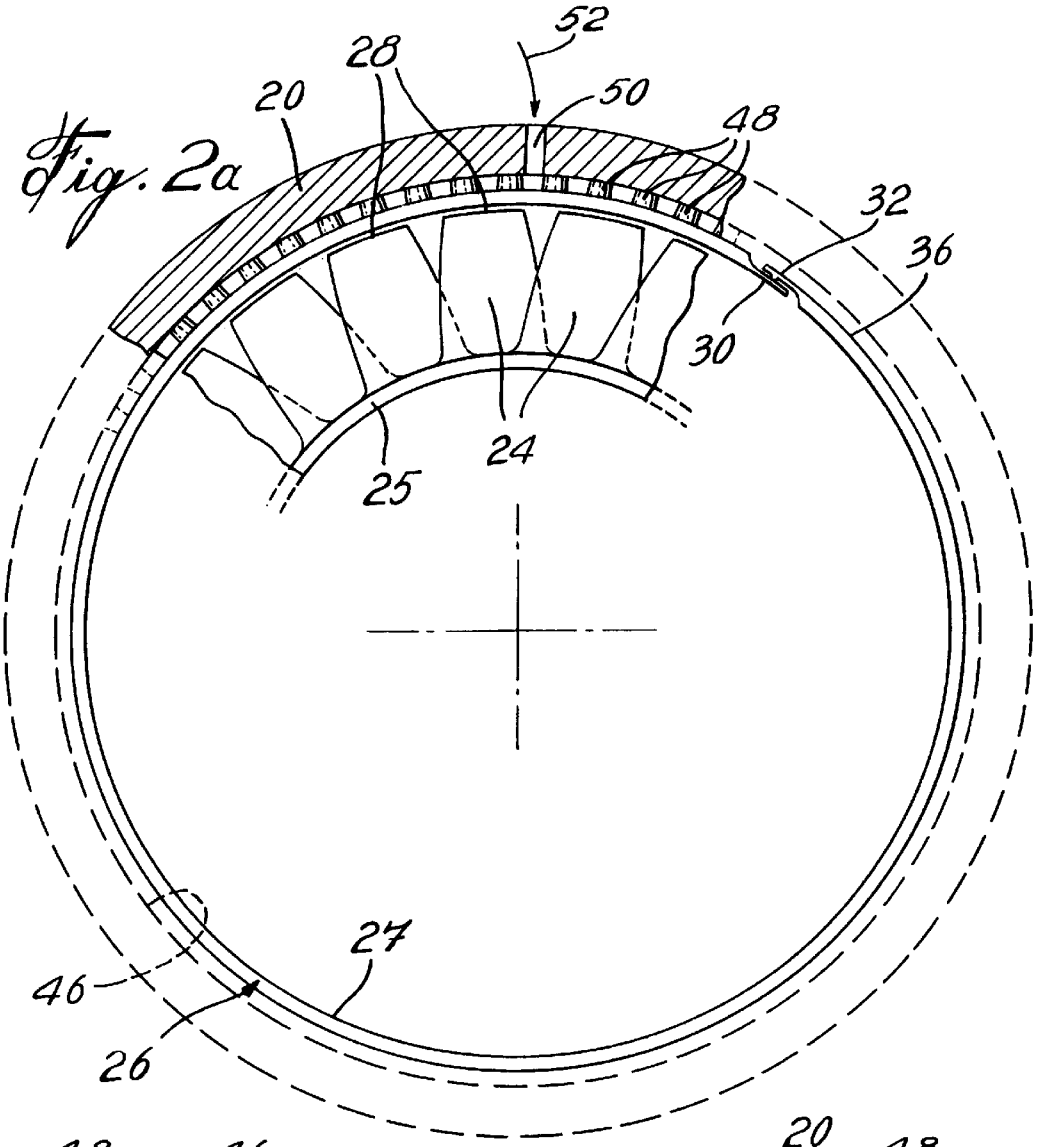
FIG. 2*a* is cross-sectional view of the turbine section illustrating the details of one of the liner rings.

FIG. 2*a* illustrates one of the ring liner 26 installed within the turbine shroud 20 about a given stage of rotor blades 24. The ring liner 26 completely surrounds the stage of rotor blades 24 and has a radially inner surface 27 which defines with the tips 28 of the rotor blades 24 an annular tip clearance C (see FIG. 3). As will be explained hereinafter, the ring liner 26 acts as a tip clearance control device which is adapted to minimize and control the tip clearance C during engine operation.

Figure 2B:
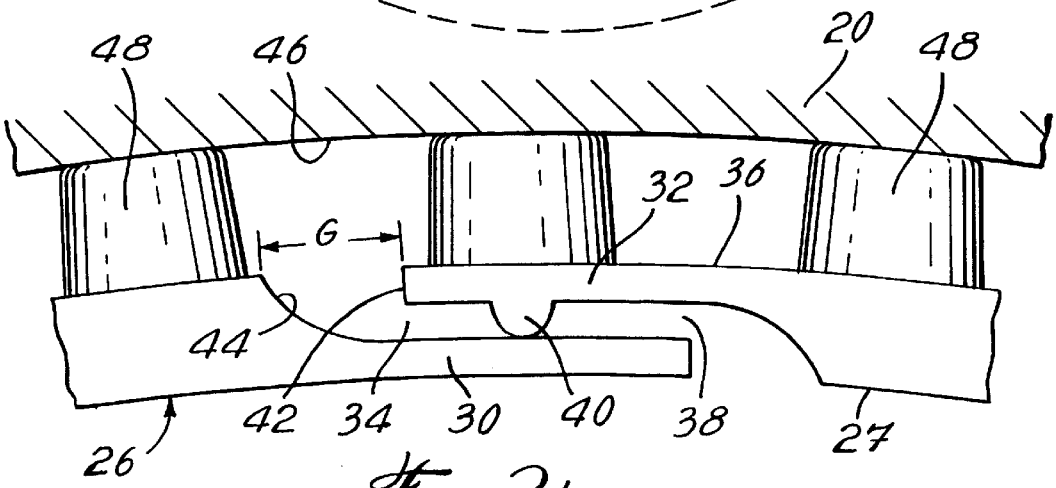
FIG. 2*b* is an enlarged sectional view of a portion of the liner ring illustrated in FIG. 2*a;*

The ring liner 26 is made in one piece and is split at a single location. As best seen in FIG. 2*b,* the ring liner 26 has a first stepped end 30 and a second opposed stepped end 32 that overlaps the first stepped end 30. The first stepped end 30 has a recessed portion 34 defined in a radially outer surface 36 of the ring liner 26, whereas the second stepped end 32 has a complementary recessed portion 38 defined in the radially inner surface 27 of the ring liner 26. A projection 40 extends radially inwardly from the second stepped end 32 to sealingly engage the first stepped end 30, thereby sealing the overlapping joint of the ring liner 26. The second stepped end 32 has a free terminal edge 42 which is circumferentially spaced from a terminal radial wall 44 of the recessed portion 34 in order to form an expansion gap G. The expansion gap G allows the liner ring 26 to grow circumferentially when exposed to hot combustion gases without virtually affecting the ring diameter and, thus, the tip clearance C.

The ring liner 26 illustrated in FIG. 2*a* is directly supported onto an inner wall 46 of the turbine shroud 20 by means of a plurality of spaced-apart pedestals 48 extending radially outwardly from the outer surface 36 of the liner ring 26. The pedestals 48 also act as turbulators to enhance the cooling effect of a cooling fluid channeled between the turbine shroud 20 and the ring liner 26 via an inlet hole 50, as indicated by arrow 52 in FIG. 2*a*.

The ring liner 26 is at least partly made of resilient material and its outside diameter, at rest, is slightly greater than the inside diameter of the turbine shroud 20. Accordingly, the ring liner 26 is preloaded with initial compression so as to adjust for eventual thermal growth of the turbine shroud 20 during operation of the engine 10. Once installed in position within the turbine shroud 20, the liner ring 26 tends to recover its rest position, thereby urging the same radially outwardly against the inner surface 46 of the turbine shroud 20. Therefore, in the event that the turbine shroud 20 is subject to a thermal growth during engine operation, the liner ring 26 will automatically expand radially outwardly to compensate for the expansion of the turbine shroud 20. This feature of the present invention prevents the liner ring 26 from becoming loose or slack within the turbine shroud 20 and thus ensure proper positioning of same relative to the rotor blades 24 during the various engine operations. By so mounting the liner ring 26 onto the inner surface 46 of the turbine shroud 20, the radial space normally required to mount a liner ring within a turbine shroud can advantageously be minimized, thereby leading to an overall engine weight reduction. Furthermore, this manner of mounting the split ring 26 onto the inner surface 46 of the turbine shroud 20 is economical as compared to conventional segmented liner rings which need to be hooked onto the turbine shroud with finely machined dimensions.

Figure 3:
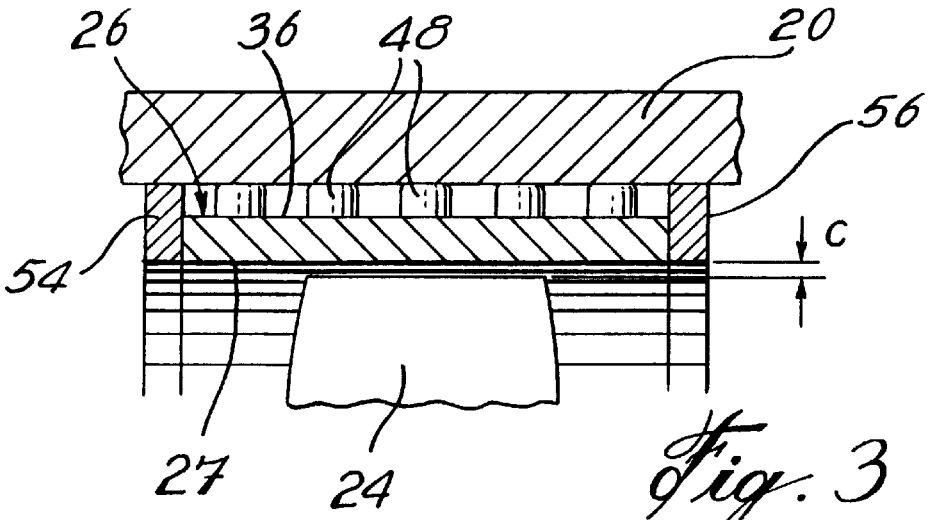
FIG. 3 is a sectional view of a portion of the turbine section illustrating how the liner ring of FIG. 2*a* is axially retained in position within the gas turbine engine.
Figure 4:
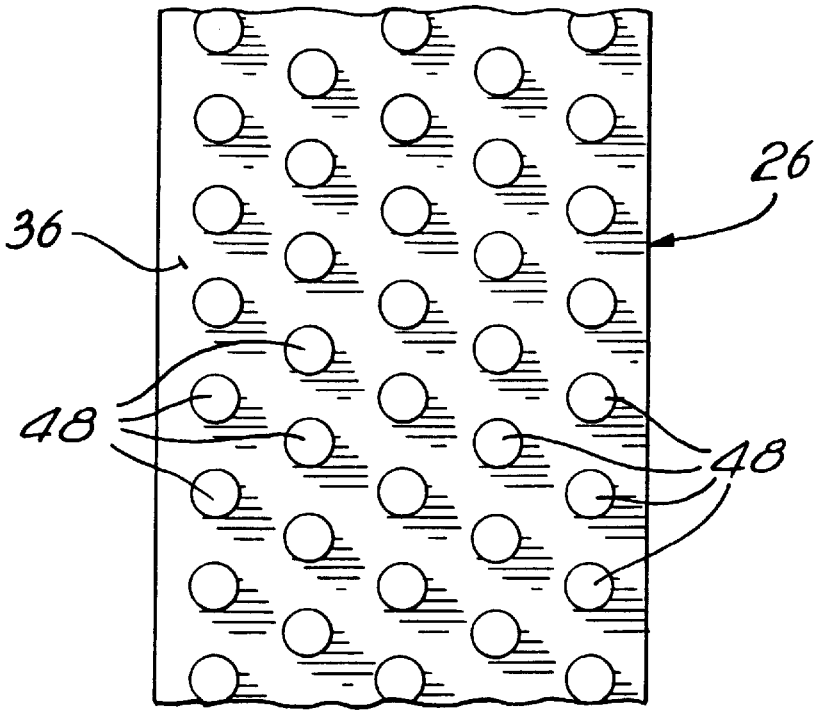
FIG. 4 is a plan view of the radially outer surface of the liner ring of FIG. 2*a*.

As seen in FIG. 3, the liner ring 26 is axially retained in position within the housing by means of a pair of retaining rings 54 and 56 respectively disposed on the upstream side and the downstream side of the rotor blades 24 and the liner ring 26. The retaining rings 54 and 56 also serve to seal the forward and aft sides of the liner ring 26. An anti-rotational system (not shown) is also provided to prevent relative rotational movements between the liner ring 26 and the turbine shroud 20. For instance, the liner ring 26 could be retained to the turbine shroud 20 against rotation via a complementary tongue and groove arrangement.

According to a preferred embodiment of the present invention, the split ring 26 is cast in a split manner from a resilient material adapted to withstand the elevated temperatures encountered in gas turbine applications. For instance, the split ring 26 could be made of nickel or cobalt alloys. It is noted that the split ring 26 has to be very thin in order to avoid radial temperature gradient between the radially inner and outer surfaces 27 and 36 thereof which are respectively exposed to hot combustion gases and to cooling air.

The use of a unitary liner ring is also advantageous over conventional segmented rings in that it reduces the amount of cooling flow required, since the continues nature of the ring eliminates the potential leak paths normally formed at the junction of adjoining segments. The use of a unitary liner ring also contributes to better isolate the turbine shroud 20 from the combustion gases, thereby ensuring that the turbine shroud 20 will remain cooler and, thus, more round during engine operations.

The above described ring liner 26 also provides improved tip clearance control in that it reduces the mechanical loads exerted on the turbine shroud 20 by eliminating the loads caused by the straightening of conventional liner segments. Furthermore, the ring liner 26 of the present invention reduces direct tip clearance loss due to segment straightening.

Finally, it is understood that the above described tip clearance control device could also be employed in the compressor section of the gas turbine engine 10.

What is claimed is:

1. A tip clearance control device for a gas turbine engine having a shroud surrounding a stage of rotor blades, said tip clearance control device comprising a split ring adapted to be mounted radially inward of said shroud in order to surround said rotor blades and adjust for expansion and contraction of said shroud, said split ring being split at a single location so as to be capable of expansion and contraction during engine operation, and wherein said split ring is spring-loaded radially outwardly to maintain frictional engagement with the shroud by elastic deformation of said split ring.

2. A tip clearance control device as defined in claim 1, wherein said split ring is provided with first and second opposed overlapping end portions.

3. A tip clearance control device as defined in claim 2, wherein said first and second opposed overlapping end portions are stepped in opposite relationship and maintained in mating engagement to form an annular seal around said rotor blades.

4. A tip clearance control device as defined in claim 3, wherein said first and second opposed overlapping end portions are respectively stepped in a radially inner surface and a radially outer surface of said split ring.

5. A tip clearance control device as defined in claim 1, wherein said split ring is at least partly resilient, and wherein said split ring has, at rest, an outside diameter which is slightly greater than an inside diameter of said shroud, whereby said split ring is compressed radially inwardly when set in position within said shroud.

6. A tip clearance control device as defined in claim 5, wherein said split ring is made of a one-piece of resilient material.

7. A tip clearance control device as defined in claim 1, wherein a plurality of spaced-apart pedestal-like members are provided along a radially outer surface of said split ring in order to promote heat transfer as a cooling fluid passes between said split ring and said shroud.

8. A tip clearance control device as defined in claim 7, wherein said spaced-apart pedestal-like members extend radially outwardly from said split ring in direct contact with said shroud.

9. In a gas turbine engine having a shroud for surrounding a stage of rotor blades at a radial distance from respective tips thereof; a tip clearance control device comprising a ring adapted to be mounted within said shroud for surrounding said rotor blades, said ring having a radially inner surface defining with said tips a tip clearance, said ring being split at a single location so as to be circumferentially expandable and contractible during engine operation, and wherein said ring is at least partly resilient and preloaded radially outwardly against the shroud to assure continuous frictional engagement therewith and prevent said ring from becoming loose within said shroud in response to radial expansion of said shroud during engine operation.

10. In a gas turbine engine, a tip clearance control device as defined in claim 9, wherein said ring is provided with first and second opposed overlapping end portions.

11. In a gas turbine engine, a tip clearance control device as defined in claim 10, wherein said first and second opposed overlapping end portions are stepped in opposite relationship and maintained in mating engagement to form an annular seal around said rotor blades.

12. In a gas turbine engine, a tip clearance control device as defined in claim 11, wherein said first and second opposed overlapping end portions are respectively stepped in said radially inner surface and an opposed radially outer surface of said ring.

13. In a gas turbine engine, a tip clearance control device as defined in claim 9, wherein said ring has, at rest, an outside diameter which is slightly greater than an inside diameter of said shroud, whereby said ring is compressed radially inwardly when set in position within said shroud.

14. In a gas turbine engine, a tip clearance control device as defined in claim 13, wherein said ring is of unitary construction.

15. In a gas turbine engine, a tip clearance control device as defined in claim 9, wherein a plurality of spaced-apart pedestal-like members are provided along a radially outer surface of said ring in order to promote heat transfer as a cooling fluid passes between said spring-loaded ring and said shroud.

16. In a gas turbine engine, a tip clearance control device as defined in claim 15, wherein said spaced-apart pedestal-like members extend radially outwardly from said ring in direct contact with said shroud.

17. A tip clearance control device for a gas turbine engine having a shroud surrounding a stage of rotor blades, said tip clearance control device comprising a one-piece ring adapted to be mounted within said shroud for surrounding said rotor blades at a radial distance from respective tips thereof, said one-piece ring having first and second opposed overlapping end portions formed at a single split location to provide an annular seal around said rotor blades, and wherein said ring is preloaded radially outwardly to assure a continuous frictional engagement with the shroud by elastic deformation of said ring.

18. A tip clearance control device as defined in claim 17, wherein said one-piece ring is adapted to be yieldingly biased radially outwardly in engagement with said shroud to adjust for expansion and contraction thereof during engine operation.

19. A tip clearance control device as defined in claim 18, wherein said one-piece ring is at least partly made of a resilient material.

20. A tip clearance control device as defined in claim 17, wherein a plurality of spaced-apart pedestal-like members extend radially outwardly from a radially outer surface of said ring in direct contact with said shroud.

* * * * *